US008911563B2

(12) United States Patent
Tiekoetter et al.

(10) Patent No.: US 8,911,563 B2
(45) Date of Patent: Dec. 16, 2014

(54) DISH WASHER

(75) Inventors: Stefan Tiekoetter, Bielefeld (DE); Martin Kornberger, Bielefeld (DE)

(73) Assignee: Miele & Cie, KG, Guetersloh (DE)

( * ) Notice: Subject to any disclaimer, the term of this patent is extended or adjusted under 35 U.S.C. 154(b) by 1086 days.

(21) Appl. No.: 12/989,818

(22) PCT Filed: Apr. 27, 2009

(86) PCT No.: PCT/EP2009/003042

§ 371 (c)(1),
(2), (4) Date: Oct. 27, 2010

(87) PCT Pub. No.: WO2009/132813

PCT Pub. Date: Nov. 5, 2009

(65) Prior Publication Data

US 2011/0036383 A1 Feb. 17, 2011

(30) Foreign Application Priority Data

Apr. 29, 2008 (DE) ..... 10 2008 021 496

(51) Int. Cl.
*A47L 15/42* (2006.01)

(52) U.S. Cl.
CPC ..... *A47L 15/4265* (2013.01); *A47L 15/4259* (2013.01); *E05Y 2201/426* (2013.01); *E05Y 2201/43* (2013.01); *E05Y 2900/304* (2013.01)
USPC ..... 134/57 DL; 134/56 D; 134/113; 312/204

(58) Field of Classification Search
CPC ..... E05Y 2900/304; E05Y 2201/426; E05Y 2201/424; A47L 15/4259; A47L 2501/22; A47L 15/4261; A47L 15/4265
USPC ..... 134/113, 56 D, 57 DL; 49/506, 138, 31; 312/204, 228, 326
See application file for complete search history.

(56) References Cited

U.S. PATENT DOCUMENTS

| | | | | |
|---|---|---|---|---|
| 5,783,918 | A * | 7/1998 | Choi | 318/447 |
| 6,675,818 | B1 * | 1/2004 | Schrott et al. | 134/57 D |
| 7,823,422 | B2 | 11/2010 | Bextermoeller et al. | |
| 2006/0283482 | A1 | 12/2006 | Berends et al. | |
| 2010/0018240 | A1 | 1/2010 | Hecht et al. | |

FOREIGN PATENT DOCUMENTS

| | | | |
|---|---|---|---|
| DE | 202005006945 | U | 5/2006 |
| DE | 2002005011427 | U1 | 11/2006 |
| DE | 102005040990 | A1 | 3/2007 |
| DE | 102006038111 | B3 | 9/2007 |

(Continued)

OTHER PUBLICATIONS

Machine English Translation of Description Section of JP2003299533 by Mitsuhisa et al.*

(Continued)

*Primary Examiner* — Michael Barr
*Assistant Examiner* — Irina Graf
(74) *Attorney, Agent, or Firm* — Leydig, Voit & Mayer, Ltd.

(57) ABSTRACT

A dishwasher includes a movable door, an opening mechanism and an opening actuator configured to move the door from a closed position to an at least partially open position. A decorative panel is resiliently attached to the door. A sensor is configured to detect movement of the decorative panel relative to the door. A controller is configured to activate the opening actuator based on movement detected by the sensor.

15 Claims, 4 Drawing Sheets

(56) References Cited

FOREIGN PATENT DOCUMENTS

| | | | | | |
|---|---|---|---|---|---|
| EP | 0669098 | A1 | | 8/1995 | |
| EP | 0772998 | A2 | | 5/1997 | |
| EP | 1714604 | A1 | * | 10/2006 | ..... A47L 15/42 |
| EP | 1935313 | A1 | | 6/2008 | |
| JP | 2003299533 | | * | 10/2003 | ..... A47B 77/08 |
| WO | 1733675 | A2 | | 12/2006 | |
| WO | WO 2008031748 | A2 | | 3/2008 | |

OTHER PUBLICATIONS

International Search Report for PCT/EP2009/003042 mailded on Sep. 16, 2009.

* cited by examiner

DISH WASHER

CROSS REFERENCE TO RELATED APPLICATIONS

This application is a U.S. National Phase application under 35 U.S.C. §371 of International Application No. PCT/EP2009/003042, filed on Apr. 27, 2009, and claims benefit to German Patent Application No. DE 10 2008 021 496.5, filed on Apr. 29, 2008. The International Application was published in German on Nov. 5, 2009 as WO 2009/132813 A1 under PCT Article 21 (2).

FIELD

The present invention relates to a dishwasher, and particularly relates to device for opening the door of a dishwasher.

German Patent Application DE 10 2005 040 990 A1 describes a dishwasher having a hinged appliance door and a decorative panel mounted to said appliance door. A visual status display and a plurality of controls are provided on a top surface of the appliance door. This allows the door to be completely covered with the decorative panel. However, it is necessary to provide a door handle on the decorative panel because there is no other gripping option. In dishwashers, a cardioid track-type mechanism which would allow the door to be initially pushed inwardly and then be resiliently pushed open cannot be used because the seal between the door appliance door and the body of the dishwasher does not allow for inward deformation and/or because leakage could occur.

European Patent Application EP 0 772 996 A2 describes a dishwasher having a hinged appliance door and a releasable door closure. The appliance door is covered with a decorative panel having a handle member mounted thereto for allowing the appliance door to be opened by pulling on the handle member. Here, too, the use of a handle member is required to be able to open the appliance door, because a certain closure force is required for the seal to ensure tightness. Thus, the appliance door should be mounted to the body in such a way that it cannot be pushed inwardly.

German Publication DE 20 2005 011 427 U1 describes a refrigerator and/or freezer appliance, in which the door is automatically opened by motor means upon actuation of a sensor. The sensor is located on the side of the appliance. Since dishwashers are generally integrated into a row of kitchen units, their side walls are not accessible. Locating the sensor on the decorative panel is also not desired because the decorative panel is delivered by the kitchen furniture manufacturer and, therefore, the furniture installer would have to make modifications.

European Patent Application EP 1 935 313 A1 describes a dishwasher in which a relative movement between the decorative panel and the door is detected by a sensor, whereupon a locking mechanism of the door is released. The door is then opened to an ajar position by the restoring forces of the door seal. If these forces are too weak, the door is then difficult to grip. If the forces are too great and the mechanism for compensating the weight of the decorative panel is set to too low a value, the door will automatically fall to the completely open position.

European Patent Application EP 1 733 675 A1 describes a dishwasher in which the door can be opened to an ajar position by means of a latch keeper that can be displaced by a motor.

International Patent Application Publication No. WO 2008/031748 A1 describes an electrodynamic sensor.

SUMMARY

In an embodiment, the present invention provides a dishwasher including a movable door, an opening mechanism and an opening actuator configured to move the door from a closed position to an at least partially open position. A decorative panel is resiliently attached to the door. A sensor is configured to detect movement of the decorative panel relative to the door. A controller is configured to activate the opening actuator based on movement detected by the sensor.

BRIEF DESCRIPTION OF THE DRAWINGS

Exemplary embodiments of the present invention will be explained in more detail below with reference to the accompanying drawings, in which:

FIG. 2 shows an opening actuator of a dishwasher;

DETAILED DESCRIPTION

Figure 1:
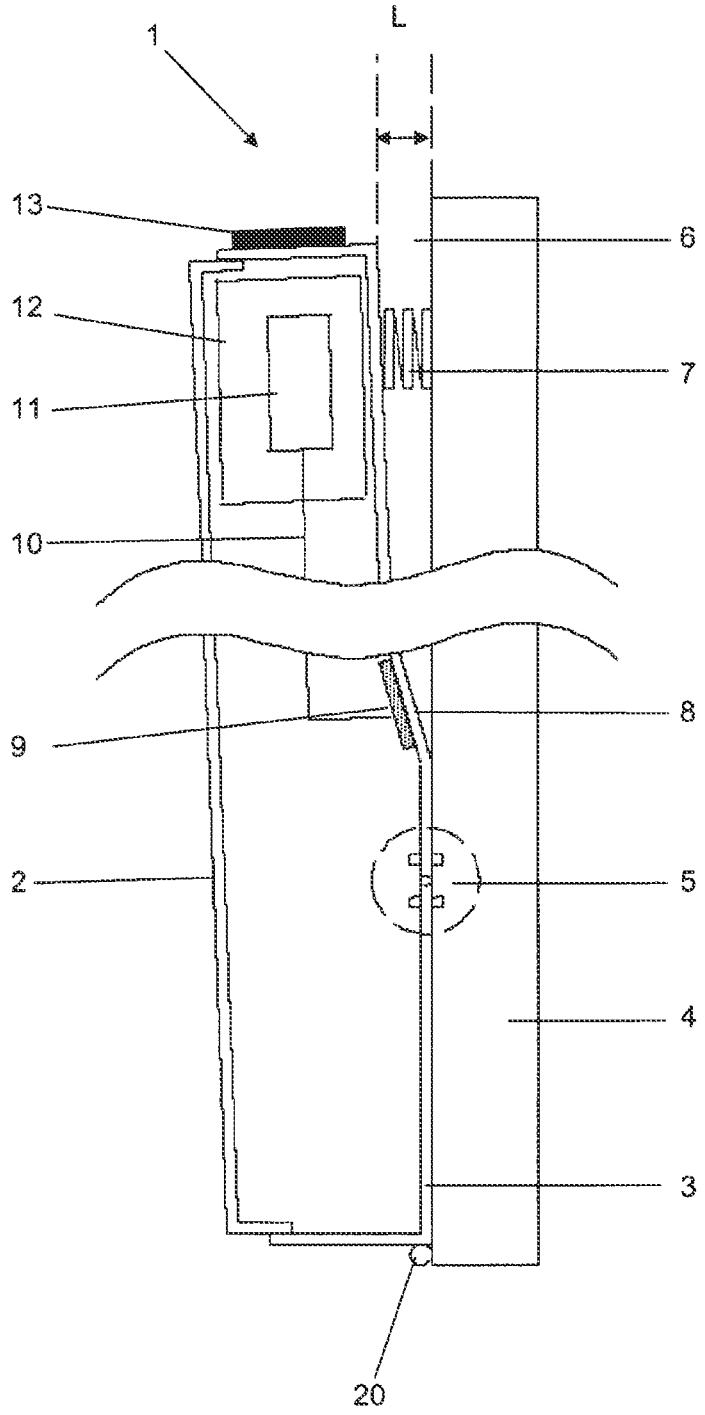
FIG. 1 is a schematic view of a door area of a household appliance according to an embodiment of the present invention.

In an embodiment, the present invention provides a dishwasher in which a decorative panel can be mounted to a hinged door in a visually appealing manner without a handle member, and which allows for easy opening of the door.

In accordance with an embodiment of the present invention, a decorative panel is resiliently mounted to the door, and a sensor is provided for detecting movement of the decorative panel relative to the door and allowing an opening actuator to be activated via a controller. Thus, the decorative panel may be mounted to the door without a handle member and can therefore be made visually appealing. The decorative panel will then form a uniform surface with adjacent cabinet doors.

In an embodiment, the decorative panel is attached to the door by a hinge joint. Parts of the hinge joint may form part of a mounting frame, which may additionally include mounting brackets for engagement with the door, and at least one resilient spacer member. In this case, the sensor may take the form of a simple switch, and the opening actuator may be activated by a slight pressure on the decorative panel. The hinge joint may be disposed in the lower region of the door and the switch can be located in the upper region of the door. This reduces the force required to operate the switch. The design described above provides the following advantages:

- The tactile properties during use are consistent with the philosophy that forms the basis for the convenience of use of high-quality handle-free kitchen unit fronts, and in particular of the drawers used here. In this connection, system compatibility may be achieved in terms of both actuation path and actuation force.
- The actuation force can be easily determined via the spring constant of the spacer members.
- The design is relatively independent of component and assembly tolerances.

The decorative panel can be easily attached and removed, even at a later time.

The gap dimension can be kept small (less than 3 mm between the control panel and the decorative panel), which makes this design also interesting in terms of visual appearance criteria.

In another embodiment, the sensor takes the form a force sensor. The door may include an outer door panel having an integrated sensor, and the sensor may detect a change in the electrostatic field or a mechanical deformation of the outer door panel.

In accordance with an embodiment, an appliance control panel is disposed on a top surface of the door. This allows the user to easily select a wash cycle or make other control inputs.

In order to facilitate operation of the door, a handle member or a handle recess may be provided on the top surface of the door.

In another embodiment, a second sensor is provided, which is also preferably located between the door and the decorative panel. In this case, an additional function may be activatable by the controller when, but not before, the signals of the first and second sensors are present. This allows for easy implementation of a child safety feature making it difficult to activate functions which may pose a hazard to the user. The sensor may take the form of a contact sensor or a proximity sensor. Then, both sensors may be triggered by pressing on the decorative panel at a specific location where the second sensor is located.

A door 1 of a household appliance, in particular of a dishwasher 100 (see FIGS. 2*a* and 2*b*), is mounted to the body of the household appliance such that it is rotatable about an axis 20. Door 1 includes an inner door panel 2 and an outer door panel 3, and a cavity formed therebetween. A decorative panel 4 is mounted to outer door panel 3. This decorative panel may form a uniform surface with adjacent decorative panels of a kitchen.

Decorative panel 4 is mounted to outer door panel 3 by fastening means 5. In an upper region of decorative panel 4, a gap 6 having a width L is provided between outer door panel 3 and decorative panel 4. Decorative panel 4 is held to outer door panel 3 such that it is biased away therefrom by a spring 7. In the region above fastening means 5, outer door panel 3 has an oblique portion 8 extending at an angle to the plane of decorative panel 4 so as to form gap 6 between outer door panel 3 and decorative panel 4.

A sensor 9 in the form of a strain gauge is provided on oblique portion 8 of outer door panel 3 and is connected to a control processor 11 via a signal line 10. Control processor 11 forms part of an appliance controller 12 which includes indicators and controls 13 which are disposed on a top surface of door 1. The controller activates an opening actuator (to be described later) which allows door 3 to be moved from a closed position on the body to an at least slightly open position. When door 1 is in a slightly open position, the user may move it by grasping a handle recess provided in the top surface of door 1.

In order to close door 1, it may be latched to the body in a simple manner. In order to open the door, the user pushes against decorative panel 4. Due to the resilient mounting of decorative panel 4, inward movement of the decorative panel 4 in the upper region in response to pressure can be detected by sensor 9, because outer door panel 3 slightly deforms in the region of oblique portion 8. This deformation is sufficient to allow detection of, for example, a change in resistance, which then causes the controller to activate an opening actuator, which is shown in FIGS. 2*a*, 2*b* and 3.

Figure 2A:
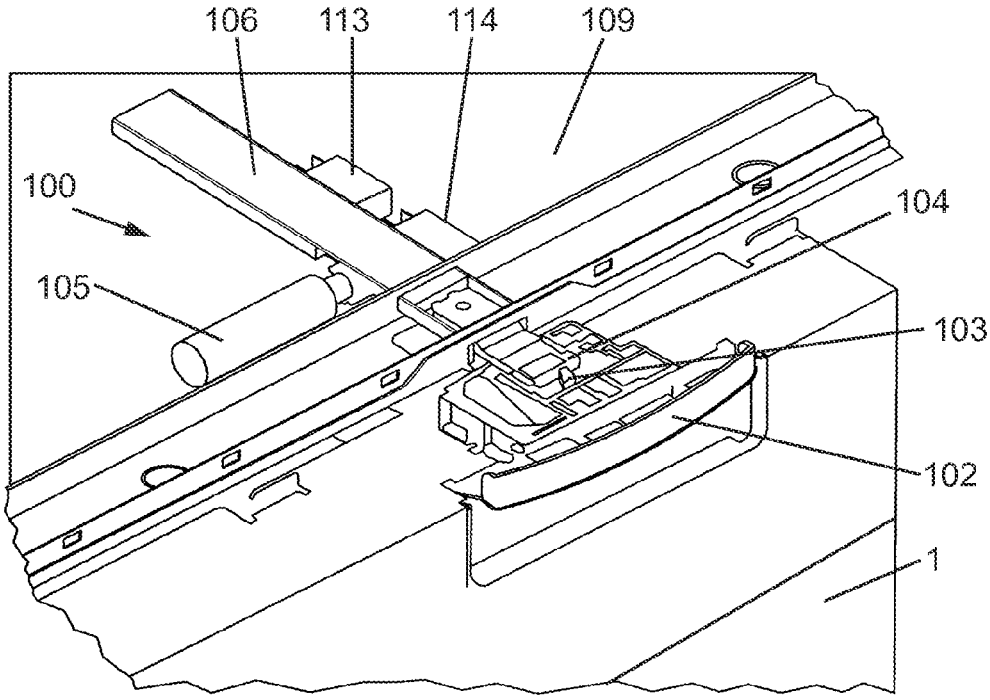
FIG. 2*a* shows the door in the closed position.
Figure 2B:
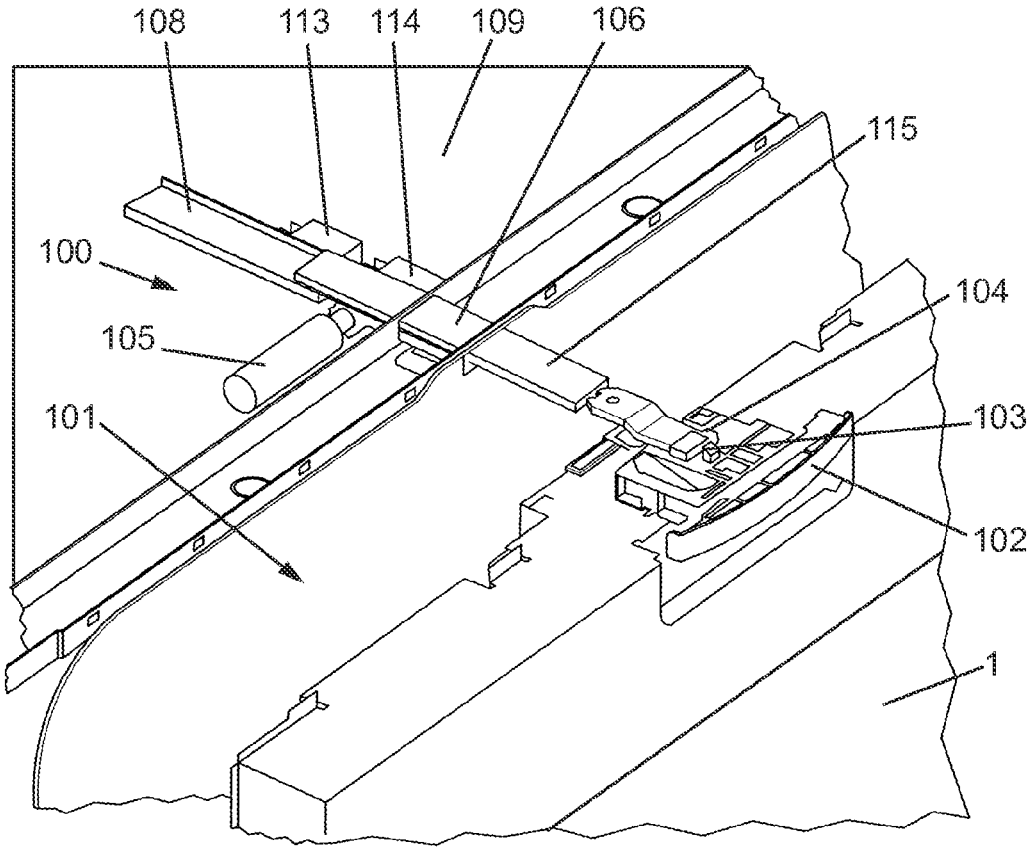
FIG. 2*b* shows the door in the open position.

FIGS. 2*a* and 2*b* show a dishwasher 100, from which the cover, control panel, outer door panel and decorative panel have been removed to better illustrate the closure mechanism. Dishwasher 100 includes a washing tub 101 and a door 1 hinged to washing tub 101, allowing it to be closed. To this end, a forked latch member 103 is rotatably mounted on door 1 in a known manner. When in the latching position, the latch member is in engagement with a latch keeper 104 mounted on washing tub 101. In order to unlatch door 1, the user must pull on it with a force sufficient to rotate latch member 103, via a mechanism not shown, to a position where it no longer holds latch keeper 104. To this end, door 1 must previously be moved to an open position allowing the user to insert his or her hand into the gap between door 1 and washing tub 101 or grasp a handle 102 provided at the upper edge of door 1. To enable door 1 to be opened to an ajar position with the aid of sensor 9, latch keeper 104 is attached to a closing plate 106 which can be linearly displaced by motor means over a distance of about ten centimeters in the opening direction of door 1. Once the sensor signal is present, motor 105 is energized by the in the appliance controller 11 of dishwasher 1.

Figure 3:
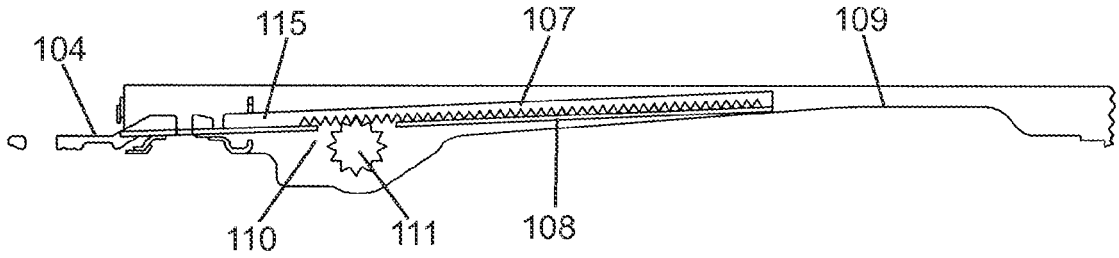
FIG. 3 is a cross-sectional side view of the opening actuator.

Further details of the closing plate 106 and its actuator are readily apparent from the cross-sectional side view of FIG. 3, which illustrates a closing plate 106 in the form of a toothed bar 107, which is provided at one end with loop-shaped latch keeper 104. Toothed bar 107 is disposed within a guide channel 108 above the washing tub. More particularly, guide channel 108 is mounted to top wall 109 of the washing tub 101 in such a way that it is slightly inclined relative thereto. Guide channel 108 has an opening 110 for a pinion 111. This opening is also where pinion 111 meshes with toothed bar 107. Pinion 111 is rotated by a motor 105 in the form of a tubular motor, possibly with an integrated gear mechanism interposed therebetween. Position switches 113 and 114 are disposed next to the guide channel, said position switches deenergizing motor 105 when toothed bar 107 is in one of its end positions, respectively. Alternatively, it is conceivable to use linear or rotary potentiometers, or optical sensors, to accurately detect the position of the toothed bar.

An integrated slip coupling means may be provided to interact with the gear mechanism. Alternatively, toothed bar 107 may itself be designed as a slip coupling means. In this case, the teeth of the toothed bar and/or of the pinion are rubber-like so as to create a pair of friction partners. In addition, or alternatively, a portion 115 of the closing plate may be toothless, but covered with an elastic layer.

A current-monitoring device is provided as an additional means to prevent overloading of motor 105, said current-monitoring device deenergizing the motor when the motor current exceeds a predetermined level.

In the embodiment shown in FIG. 1, the sensor 9 used is a strain gauge. It is also possible to connect other sensors to the controller, such as a piezoelectric film, a capacitor foil, or a metal foil, to detect either a change in resistance, a change in capacitance, or a change in the electrostatic field. The door shown in FIG. 1 is intended for what is known as a fully integrated dishwasher, meaning that indicators and controls 13 are disposed on the top surface of door 1. Alternatively, the above-described opening mechanism may be used in a door such as the one illustrated in FIGS. 2*a* and 2*b*, where the controls and indicators are disposed on the front above the decorative panel.

Figure 4:
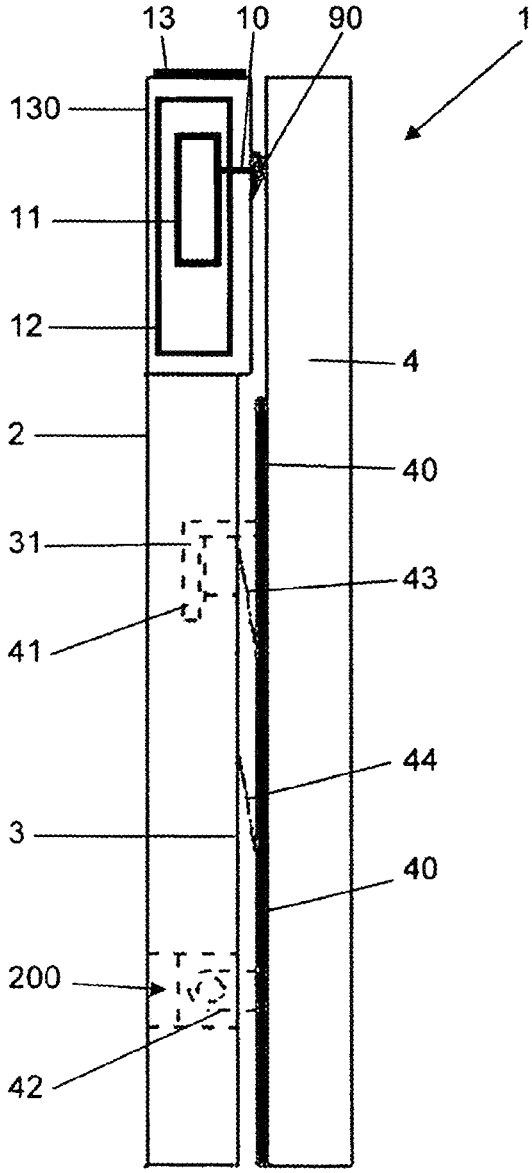
FIG. 4 a door area of another embodiment of the present invention.

FIG. 4 shows another embodiment of a door that is intended for a fully integrated dishwasher. In this door, a switch 90 is intended to be used in place of a force sensor 9 (exemplary embodiment according to FIG. 1). Alternatively, it would be possible to use an electrodynamic sensor. In this manner, the relative movement required to trip the sensor (switch 90) may be achieved with significantly less pressure on decorative panel 4. For this purpose, decorative panel 4 is attached to door 1 by a hinge joint 200. As shown in the side view of FIG. 4, panel 4 is attached to door 1 by a mounting frame 40. In this figure, dishwasher door 1, shown with decorative panel 4, inner door panel 2 and outer door panel 3, has as separate control panel insert 130 to accommodate controls and indicators 13 as well as appliance controller 12, including control processor 11. Mounting frame 40 is first screwed to decorative panel 4. The mounting frame includes mounting brackets 41 in the central to upper portion thereof, said mounting brackets engaging with retaining means 31 on outer door panel 3, and further includes hinge eyes 42 of a hinge joint and spacer members 43 and 44 in the form of flat springs.

Figure 5:
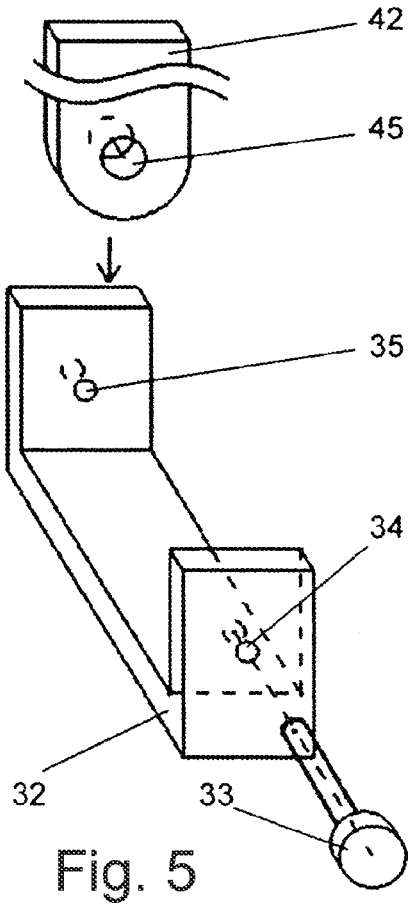
FIG. 5 shows a hinge joint for a decorative panel.

After placing mounting brackets 41 in retaining means 31, hinge eyes 42 get into the region of two U-shaped brackets 32, which are mounted to outer door panel 3 in the lower lateral regions thereof. To provide for rotatable attachment of decorative panel 4, two shank screws 33 (DIN 427) are passed through bores 45 of hinge eyes 42 and through outer throughholes 34 in brackets 32, and are then turned into inner threaded holes 35 in the brackets. FIG. 5 shows left bracket 32 (as seen from a position standing in front of the dishwasher) with shaft screw 33 and hinge eye 42. Right bracket 32 is mounted to outer door panel 3 in mirrored relationship.

The sensor 90 used may be a short-stroke foil button which, having a very flat design with a height of typically about 1.5 mm, has a very short contact travel on the order of less than 1 mm. Moreover, these buttons have proved to be very rugged. The short-stroke foil button is glued onto control panel insert 130. In order to increase the pressure, a boss may be glued onto decorative panel 4 in the sensor region. The pressure required to actuate the button is determined by resilient spacer members 43 and 44 which, in addition, exert a restoring torque on panel 4. The configuration according to the present invention makes it possible to achieve actuation paths of less than 3 mm, preferably of between 1.5 and 2 mm. Thus, it permits the use of a handle-free decorative panel 4 for a preferably handle-free, fully integrated dishwasher 100, allowing the dishwasher to fit without compromises with the appearance of handle-free drawer fronts and their tactile feel during use.

Figure 6:
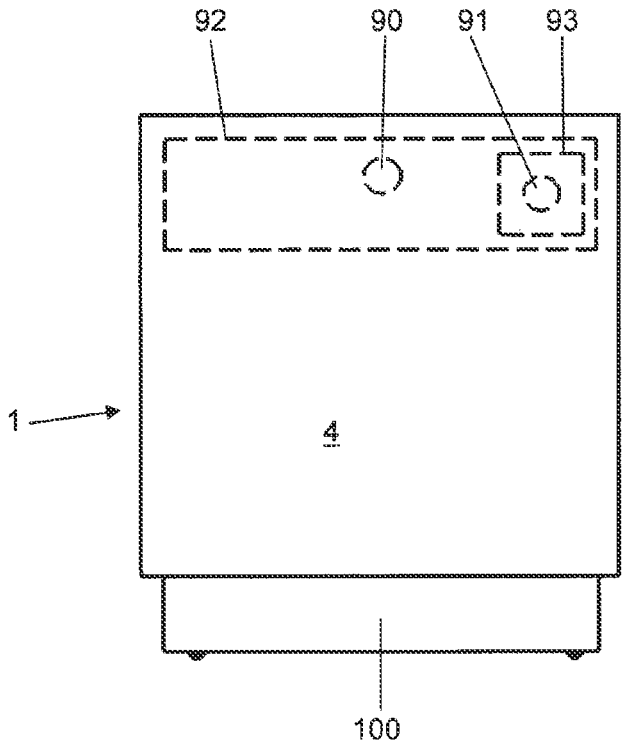
FIG. 6 is a front view of a door having two sensors.

FIG. 6 shows, by way of example, a dishwasher 100, whose door front includes a second sensor 91 disposed between door 1 and decorative panel 4. In this manner, two sensitive regions 92 and 93 are created which each generate a sensor signal in response to a push on decorative panel 4. In the exemplary embodiment shown, first sensitive region 92 extends symmetrically across the width of the upper portion of decorative panel 4, and second sensitive region 93 is located within the first one, forming a sub-segment of first region 92, it being preferred for the second sensitive region to be located off-center to the left or right near the lateral edge of the decorative panel. Sensors 90 and 91 are located in the center of the respective region 92 or 93. First sensor 90 is preferably a force-actuated sensor, such as the short-stroke foil button known from the exemplary embodiment according to FIG. 4. Second sensor 91 may preferably be actuated without applying force. For this purpose, it is possible to use a capacitive proximity sensor or a contact sensor that emits a signal only when touched in the sensitive region. Here, too, an electrodynamic sensor known from WO 2008/031748 A1 may be used as the first sensor.

When the user pushes against decorative panel 4 in the central or left portion of first sensitive region 92; i.e., outside of second sensitive region 93, only sensor 90 emits a signal to control processor 11. This requires a certain amount of force. Upon such actuation, appliance controller 12 activates the opening actuator illustrated in FIGS. 2 and 3. Second sensor 91 is used to activate another function via controller 12. Such a function may be one which, when used improperly, may pose a risk to the user. Examples of such functions include starting or continuing a cycle after opening and closing of door 1. To prevent accidental activation of such a function, control processor 11 checks whether signals are emitted by both first sensor 90 and second sensor 91. This is only the case if a certain pressure is exerted against second sensitive region 93, causing both sensors 90 and 91 to be activated. Via such a function, a child safety feature may be implemented to prevent the appliance from being activated by unauthorized persons.

Using an electrodynamic sensor, a child safety feature may be implemented via an actuation profile (speed, force, frequency, or the like) which is detected by control processor 11 and compared to a profile stored in appliance controller 12. If a match is found, door 1 is opened, otherwise it is not.

It is to be understood that the present invention is not limited to providing only two sensitive regions.

While the invention has been particularly shown and described with reference to preferred embodiments thereof, it will be understood by those skilled in the art that various changes in form and details may be made therein without departing from the spirit and scope of the invention.

What is claimed is:

1. A dishwasher comprising:

a movable door including an outer door panel;

an opening mechanism;

an opening actuator configured to move the door from a closed position to an at least partially open position;

a decorative panel resiliently attached to the door;

a sensor configured to detect movement of the decorative panel toward the door, the sensor being integrated in the outer door panel so as to enable detection of a change in at least one of an electrostatic field or a mechanical deformation of the outer door panel; and a controller configured to activate the opening actuator based on movement detected by the sensor.

2. The dishwasher as recited in claim 1, wherein the decorative panel is attached to the door with a hinge joint.

3. The dishwasher as recited in claim 2, wherein at least a part of the hinge joint is part of a mounting frame.

4. The dishwasher as recited in claim 3, wherein the mounting frame includes a mounting bracket that engages the door and at least one resilient spacer member.

5. The dishwasher as recited in claim 1, wherein the sensor includes a switch.

6. The dishwasher as recited in claim 1, wherein the sensor includes an electrodynamic sensor.

7. The dishwasher as recited in claim 2, wherein the hinge joint is disposed in a lower region of the door and the sensor is disposed in an upper region of the door.

8. The dishwasher as recited in claim 1, wherein the sensor includes a force sensor.

9. The dishwasher as recited in claim 1, further comprising at least one of a control and an indicator disposed on a top surface of the door.

10. The dishwasher as recited in claim 1, further comprising at least one of a handle member and a handle recess disposed on a top surface of the door.

11. The dishwasher as recited in claim 1, wherein the sensor is a first sensor and the dishwasher further comprises a second sensor.

12. The dishwasher as recited in claim 11, wherein the second sensor is disposed between the door and the decorative panel.

13. The dishwasher as recited in claim 11, wherein the controller is configured to activate an additional function in response to a presence of signals from the sensor and the second sensor.

14. The dishwasher as recited in claim 11, wherein the second sensor includes at least one of a contact sensor and a proximity sensor.

15. A dishwasher comprising:

a movable door including an outer door panel;

an opening mechanism;

an opening actuator configured to move the door from a closed position to an at least partially open position;

at least one of a fastener and a mounting bracket configured to resiliently attach a decorative panel to the door;

a sensor configured to detect movement of the decorative panel toward the door, the sensor being integrated in the outer door panel so as to enable detection of a change in at least one of an electrostatic field or a mechanical deformation of the outer door panel; and a controller configured to activate the opening actuator based on movement detected by the sensor.

* * * * *